US011235958B2

(12) United States Patent
Schüll

(10) Patent No.: US 11,235,958 B2
(45) Date of Patent: Feb. 1, 2022

(54) WORK MACHINE AND METHOD FOR OPERATING THE WORK MACHINE

(71) Applicant: BAUER Maschinen GmbH, Schrobenhausen (DE)

(72) Inventor: Andreas Schüll, Gerolsbach (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 59 days.

(21) Appl. No.: 16/816,086

(22) Filed: Mar. 11, 2020

(65) Prior Publication Data

US 2020/0290846 A1 Sep. 17, 2020

(30) Foreign Application Priority Data

Mar. 12, 2019 (EP) ..... 19162283

(51) Int. Cl.
*B66C 13/00* (2006.01)
*B66C 13/10* (2006.01)
(Continued)

(52) U.S. Cl.
CPC ..... *B66C 13/10* (2013.01); *B30B 15/148* (2013.01); *B66C 23/18* (2013.01); *E02D 3/046* (2013.01)

(58) Field of Classification Search
CPC ..... B66C 13/10; B66C 13/105; B66C 15/00; B66C 23/18; B66C 23/88; B30B 15/148;
(Continued)

(56) References Cited

U.S. PATENT DOCUMENTS 4,560,074 A * 12/1985 Manning ..... B66C 23/203 212/179
2011/0272377 A1* 11/2011 Willim ..... B66C 13/06 212/285

(Continued)

FOREIGN PATENT DOCUMENTS

CA 2888446 A1 * 4/2014 ..... B66C 13/10
DE 10 40 215 B 10/1958

(Continued)

*Primary Examiner* — Emmanuel M Marcelo
(74) *Attorney, Agent, or Firm* — Studebaker & Brackett PC

(57) ABSTRACT

The invention relates to a work machine, comprising a mast having a mast head, a support cable which is guided along the mast, over the mast head, a cable winch comprising a rotatably mounted winding drum to which the support cable is attached for winding up and unwinding, a work element which is arranged on the support cable for vertical movement, and a control unit, by means of which the cable winch can be operated in an unwinding mode, for unwinding the support cable from the winding drum, in which mode the work element is lowered, on the support cable, as far as a base surface. According to the invention, a cable contact pressure means comprising at least one contact pressure element is provided, which element can be adjusted into a contact pressure position by the control unit, by means of an actuating member, in order to counteract a cable oscillation of the support cable when the base surface is struck, in which contact pressure position the contact pressure element rests on the support cable at a contact pressure force.

13 Claims, 8 Drawing Sheets

(51) Int. Cl.

| | |
|---|---|
| ***B30B 15/14*** | (2006.01) |
| ***B66C 23/18*** | (2006.01) |
| ***E02D 3/046*** | (2006.01) |

(58) Field of Classification Search
CPC .. E02D 3/046; B66D 1/40; B66D 1/36; B66D 1/38
See application file for complete search history.

(56) References Cited

U.S. PATENT DOCUMENTS

| | | | | |
|---|---|---|---|---|
| 2016/0002010 | A1* | 1/2016 | May | E04G 23/084 212/273 |
| 2018/0230760 | A1* | 8/2018 | Urguhart | E21B 19/08 |

FOREIGN PATENT DOCUMENTS

| | | | |
|---|---|---|---|
| DE | 289 994 | A5 | 5/1991 |
| EP | 3 144 260 | A1 | 3/2017 |
| EP | 3 272 944 | A1 | 1/2018 |

* cited by examiner

WORK MACHINE AND METHOD FOR OPERATING THE WORK MACHINE

The invention relates to a work machine, in particular a construction machine, comprising a mast having a mast head, a support cable that is guided along the mast, via the mast head, a cable winch comprising a rotatably mounted winding drum to which the support cable is attached for winding up and unwinding, a work element which is arranged on the support cable for the purpose of vertical movement, and a control unit by means of which the cable winch can be operated in an unwinding mode, for unwinding the support cable from the winding drum, in which mode the work element is lowered, on the support cable, as far as a base surface.

The invention furthermore relates to a method for operating a work machine of this kind.

A work machine of the type in question follows for example from EP 3 144 260 B1. In this case, a support cable is guided over a mast head, on a mast, in order to raise and lower a lifting element as quickly as possible, by means of a cable winch assembly.

When a work element is lowered by means of a work machine of this kind, it is generally the case that the work element is braked, by means of a corresponding brake assembly on the cable drums, before said element strikes the ground. If the work element nonetheless strikes a base surface, in particular the ground, at a relatively high lowering speed, an undesired cable oscillation may form on the support cable, which oscillation propagates over the mast head, as far as a winding drum. Said cable oscillation can result in cable windings on the winding drum springing out of their intended position. During further operation of the winding drum, this can lead to untidy winding up of the support cable on the winding drum, having crossing cable regions.

An untidy cable winding of this kind on the winding drum can lead to damage to the winding drum, and in particular to increased wear of the support cable. As a result, not only may the service life of the support cable reduce significantly, but the maximum bearing load of the support cable as a whole may be adversely affected.

It is known in principle to provide guide means, on a winding drum, for purposeful guidance and introduction of the support cable on the winding drum. As a result of the arising cable oscillations, however, guide means of this kind can also be overloaded and damaged, or bypassed.

The object of the invention is that of specifying a work machine and a method for operating the work machine, by means of which the negative impacts of cable oscillation of the support cable can be counteracted.

The work machine according to the invention is characterized in that a cable contact pressure means comprising at least one contact pressure element is provided, which means can be adjusted into a contact pressure position by a control unit, by means of an actuating member, in order to counteract a cable oscillation of the support cable when the work element strikes the base surface, in which contact pressure position the contact pressure element rests on the support cable at a contact pressure force.

In this case, the invention is based on the finding that, in the case of a work or lifting element on a support cable intentionally or unintentionally striking a base or ground surface, a cable oscillation can be counteracted, at least in regions, in that a defined contact pressure force is applied to the support cable by means of a cable contact pressure element. It is thus possible for a position of the support cable to be fixed or tensioned, at least in regions, such that propagation of a cable oscillation can be counteracted thereby. The work element may be a tool, a gripper, a lifting hook comprising a load, or another bearing load.

A preferred embodiment of the invention consists in the contact pressure element being adjustable by the control unit, from a retracted position into the contact pressure position, either directly before, or while, the work element strikes the base surface. In order to prevent unnecessary cable friction, and thus frictional wear, according to a preferred embodiment of the invention the contact pressure element is kept in the contact pressure position on the support cable only briefly. In this case, contact on the support cable takes place in a short time period before anticipated striking, or in the case of striking, of the work element on the base surface. In the event of raising of the work element, the contact pressure force can be released again.

The control unit can specify any winding mode, for example a control program having a defined progression of a winding speed. In the simplest case, the control unit can be designed such that it is designed for free manual operation by an operator.

The effect and the formation of a cable oscillation is greater the faster the work element is lowered, and the higher the striking speed onto a base surface. In particular, the use of a work machine according to the invention is advantageous if the winding mode is a freefall mode. The base surface may be the ground, another surface, or a fluid surface.

Within the meaning of the invention, a freefall mode can be understood to mean a winding mode in which the winding drum is substantially not braked, or is operated in another non-positive manner, during freefall lowering. A freefall mode of this kind can be advantageous in particular if, for example for ground compaction, dropping the impact weight is intended to produce impact momentum.

According to a development of the invention, particularly good suppression of a cable oscillation can be achieved in that the cable contact pressure means is arranged between the mast head and the winding drum, in particular close to the winding drum. As a result, propagation of a cable oscillation in the region of the winding drum and to the cable winding is reliably counteracted.

In order to achieve a particularly compact structure of the work machine according to the invention, it is preferable for a single contact pressure element to be pressed against the support cable in the contact pressure position. In many cases, sufficient curbing of a cable oscillation can already be achieved thereby.

In order to reduce the cable wear, and also friction on the contact pressure element, according to an embodiment of the invention it is advantageous for the at least one contact pressure element to be provided with a roller, in which the support cable comes to rest.

In principle, the contact pressure element can press freely on the support cable. A particularly expedient variant of the invention can be considered that of the contact pressure element pressing the support cable against the winding drum, in the contact pressure position. In this case, the contact pressure element can be rod-shaped or preferably plate-shaped, wherein the plate is adjusted to the curvature of the winding drum. In this case, the contact pressure element can extend substantially over the axial length of the winding drum, such that the wound cable is reliably pressed against the winding drum, even in the case of significant cable oscillation.

A further advantageous embodiment of the invention results from two contact pressure elements being provided opposite one another, the support cable being guided through between the two contact pressure elements, and both contact pressure elements being pressed against the support cable, in the contact pressure position. The two contact pressure elements can be arranged so as to be directly opposite one another or so as to be at a certain offset, in a longitudinal direction of the support cable. In this case, a double contact pressure force, as it were, is exerted on the support cable, such that propagation of the cable oscillation is counteracted particularly effectively.

In principle, the cable contact pressure means can be controlled by the control unit, by means of a specified program which presses the contact pressure element on the support cable at particular time points. It is advantageously possible for the control unit to be designed such that, in the event of stopping or braking of the cable drum, the contact pressure element is placed against the support cable at a specified contact pressure force. A particularly expedient variant of the work machine according to the invention consists in a determination means being provided which is designed for determining a position of the work element on the support cable and/or a state of the support cable, in particular a tension state of the support cable, the determination means being connected to the control unit, and it being possible for the cable contact pressure means to be actuated by the control unit depending on the determined position and/or the state of the support cable. Actuation preferably takes place when the work element strikes the ground.

The determination means can for example determine a length of the support cable, approximately independently of the number of revolutions of the winding drum. Furthermore, another state of the support cable, in particular a tension state of the support cable, can also be recorded by the determination means. It is thus possible, for example, for a dynamometer to be provided on a deflection roller on the mast head, which dynamometer can determine a tensile force on the support cable. If for example the tensile force falls below a specified value, or if said tensile force drops rapidly, this can be identified by the controller as occurrence of cable oscillation. The determination means can also comprise a camera which optically records a cable oscillation.

A determination means of this kind thus makes it possible to particularly reliably record the appearance of cable oscillation, and the cable contact pressure means is actuated in accordance with need. Adjustment of the contact pressure element is achieved in particular by means of an actuating member, in particular an actuating cylinder, particularly preferably a hydraulic cylinder.

In particular in the case of the cable contact pressure means arranged close to the winch, it may be advantageous for the position of the mast, in particular with respect to the angular position relative to the vertical, to be adjustable, and for the cable contact pressure means to be adjustable depending on the position of the mast. In particular if the mast is designed as a boom mast which can be adjusted in a large angular range, adjustable mounting of the cable contact pressure means is expedient. As a result, a desired spacing between the contact pressure element and the support cable can be ensured, even if the position of the support cable changes as a result of a shift in position of the mast. The re-adjustment means provided for this purpose can be manually operable or can preferably be achieved by means of at least one actuating member. This may comprise an actuating cylinder, preferably a hydraulic cylinder. The actuating member can be actuated by the operator or in particular by means of control on the basis of the position displacement of the mast.

In principle, the work machine according to the invention can be designed as desired, in particular as a crane or a construction machine According to an embodiment of the invention, it is particularly advantageous for the work machine to be designed as a crawler crane, wherein an impact device for soil compaction is suspended on the support cable as the work element. A crawler crane is often also referred to as a cable dredger, wherein this is essentially a displaceable crane comprising a crawler chassis. A boom mast is arranged on a preferably rotatable superstructure on the crawler chassis, which boom mast is used in particular on construction sites, for lifting work. In this case, in particular an impact weight is provided as the work element, which weight is repeatedly raised, and preferably dropped in a freefall mode, from a specified height, onto ground to be compacted, for the purpose of soil compaction. As a result, a simple but at the same time very effective method for soil compaction can be carried out.

In the method according to the invention for operating a work machine, in particular a construction machine, according to the invention a support cable is guided along a mast, over a mast head, wherein the support cable is attached to a rotatably mounted winding drum of a cable winch for winding up and unwinding, and a work element is arranged on the support cable, which work element is moved vertically by the support cable, wherein a control unit unwinds the support cable from the winding drum of the cable winch in an unwinding mode, in which the work element is lowered as far as a base surface, wherein at least one contact pressure element of a cable contact pressure means is pressed onto the support cable, at a contact pressure force and in a contact pressure position, by the control unit, by means of an actuating member, when the work element strikes the base surface, wherein a cable oscillation of the support cable is counteracted.

The method can be carried out in particular by means of a work machine as described above. The method makes it possible to achieve the above-described advantages. In principle, the method can be used anywhere that quick, and in particular repeated, lowering of a work element on a support cable is desired.

A preferred method variant of the invention consists in an impact weight being provided as the work element, and the impact weight being repeatedly dropped onto the ground, in a freefall mode, in order to compact the soil. It is thus possible to carry out simple and effective soil compaction in a manner having reliable cable guidance.

The invention will be described further in the following, with reference to preferred embodiments that are shown schematically in the drawings, in which.

Figure 1:
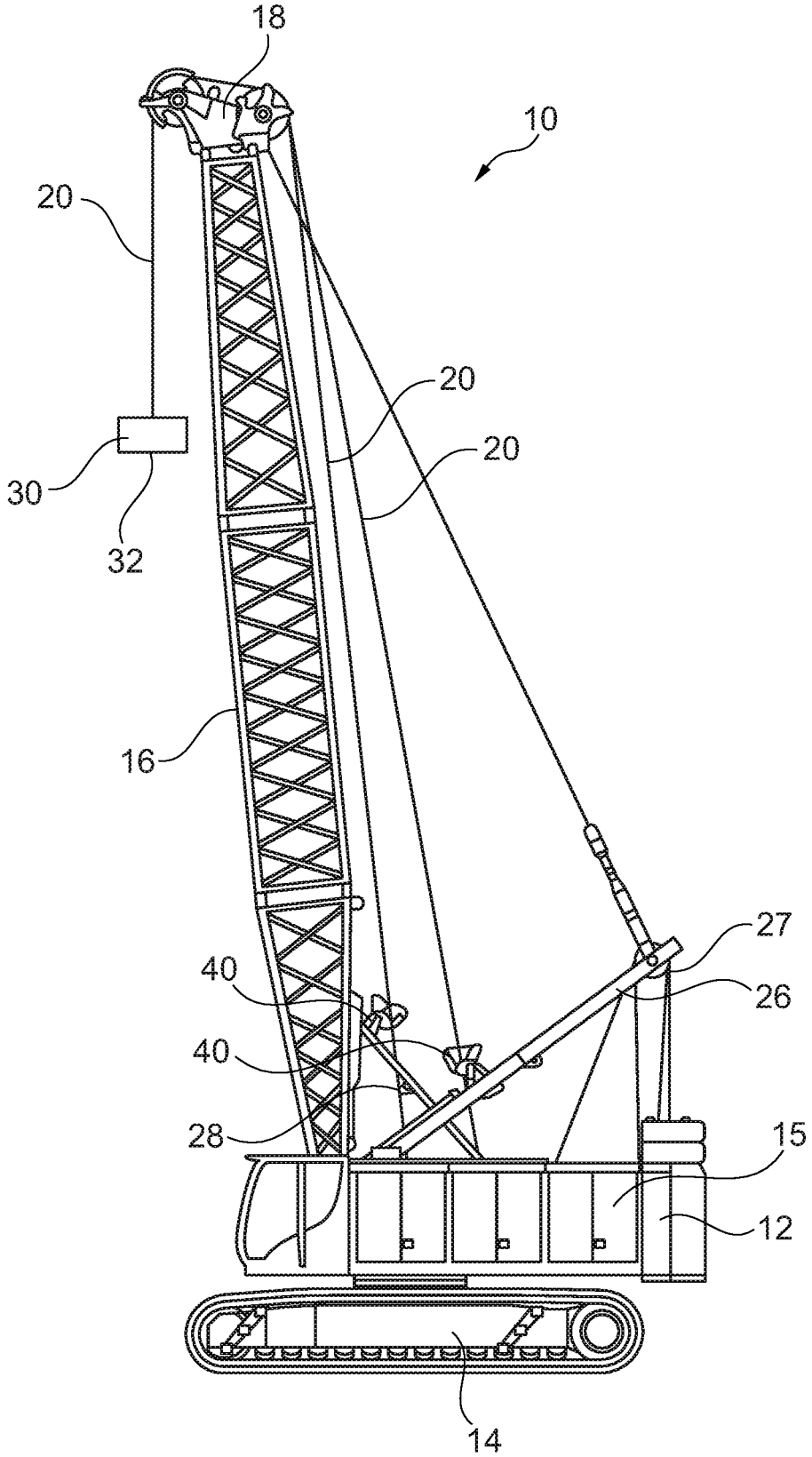
FIG. 1 is a side view of a work machine according to the invention, which is designed as a crawler crane.

A work machine 10 according to the invention from FIG. 1, which is designed as a crawler crane, comprises a mobile carrier device 12. The carrier device 12 comprises a crawler chassis 14 on which a superstructure 15 is rotatably mounted. A mast 16, which is also referred to as a boom arm, is mounted on the superstructure 15 so as to be pivotable about a horizontal pivot axis. In order to pivot the mast 16, a retaining carrier 26, a supporting carrier 28 and a cable positioning mechanism 27 are provided on the superstructure 15, in a manner known in principle.

At least one support cable 20 is guided from the superstructure 15, over a mast head 18 of the mast 16, on which cable a work element 30 is suspended, which work element is designed, in the embodiment shown, as an impact weight 32 for soil compaction. In the embodiment, the support cable 20 is adjustably driven in the superstructure 15, by means of a dual winch arrangement, as is known in principle from the prior art. In order to prevent cable oscillation, one cable contact pressure means 40 in each case is arranged on each of the total of two portions of the support cable 20, one of which portions is attached to the retaining carrier 26, also referred to as an A-beam, and the other of which portions is attached to the mast 16. The ends of the support cable 20 are in each case attached to one cable winch, respectively, in the superstructure 15, so as to provide a dual cable winch arrangement for quick lifting processes.

Figure 2:
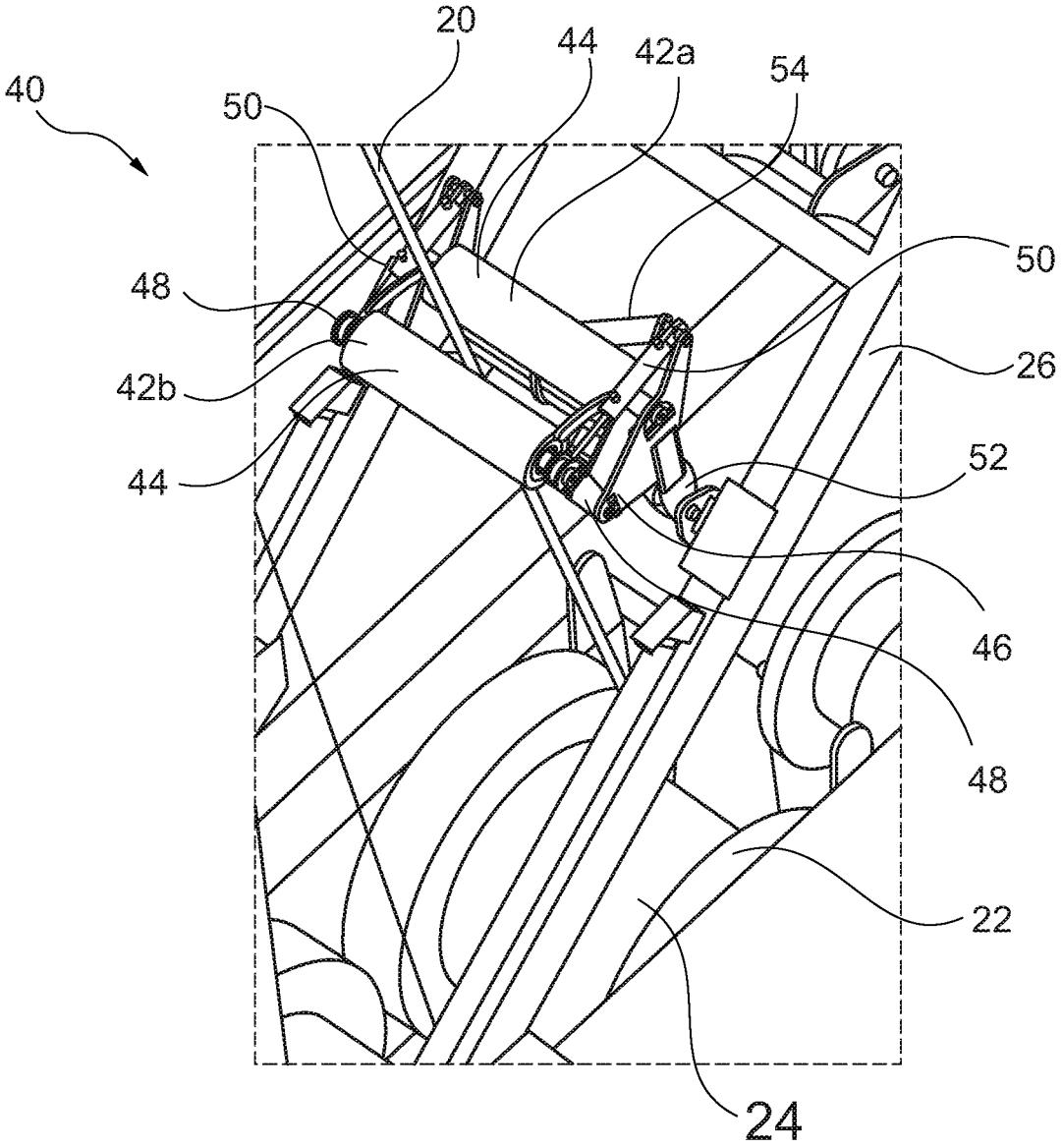
FIG. 2 is an enlarged perspective detail view of a cable contact pressure means according to the invention, in the retracted position.
Figure 3:
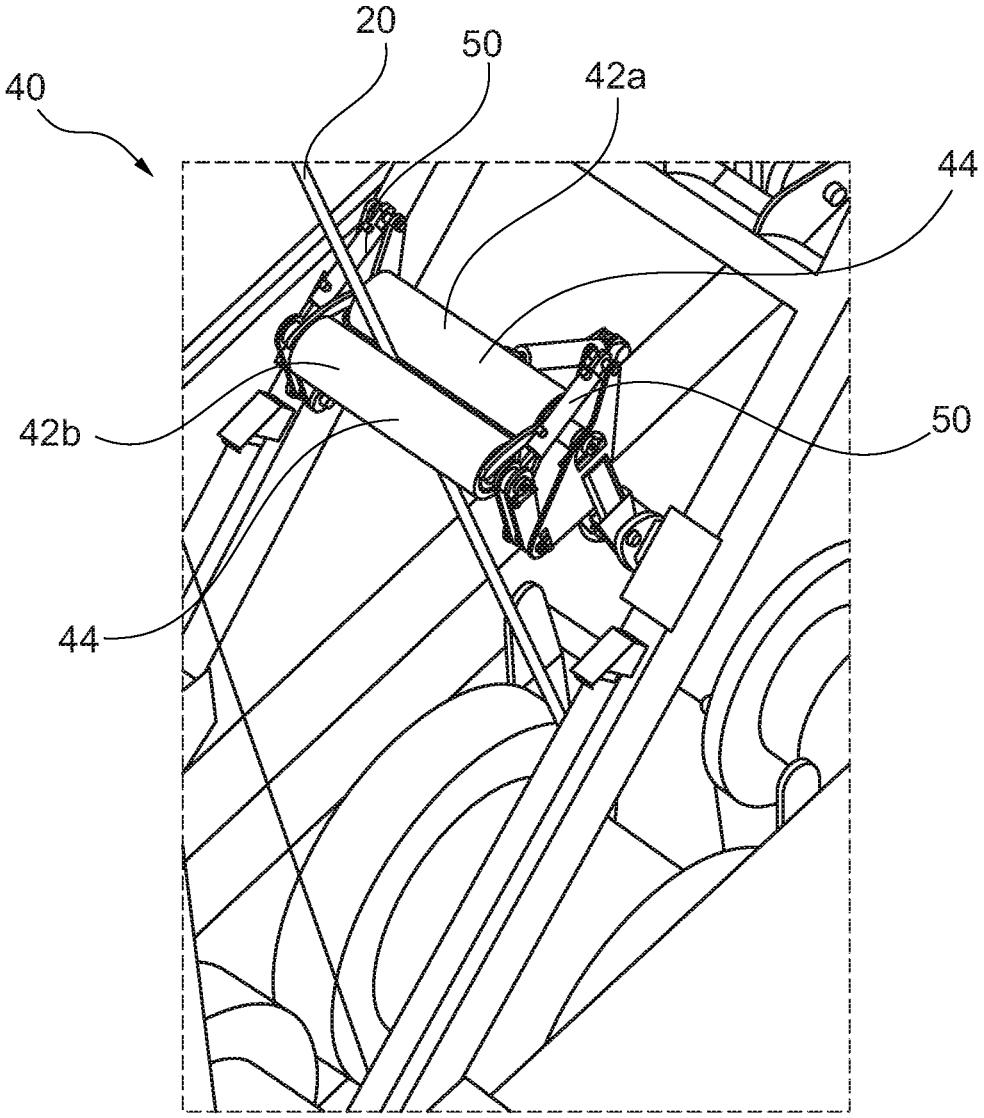
FIG. 3 is a perspective detail view of the cable contact pressure means of FIG. 2, in the contact pressure position.

FIGS. 2 and 3 show a first embodiment of a cable contact pressure means 40 in greater detail, which contact pressure means is adjustably mounted on the retaining carrier 26. In this case, the cable contact pressure means 40 comprises a first contact pressure element 42*a* that is mounted on a base support 46, as a rotatable roller 44. Furthermore, a second contact pressure element 42*b* that is also designed as a roller 44 is likewise provided, and is rotatably mounted on two lateral rocker arms 48. The two rocker arms 48 are pivotably mounted on the base support 46 and connected thereto by means of a linear actuating member 50 in each case, which member is designed as a hydraulic cylinder.

FIG. 2 shows the cable contact pressure means 40 in a state in which the support cable 20 extends without contact, or at most in a manner having slight contact, between the two contact pressure elements 42*a*, 42*b*, downwards towards a cable winch 22, having a winding drum 24 that is rotatably mounted in the superstructure. Winding up and unwinding the support cable 20 onto or from the winding drum 24 makes it possible for the work element 30 to be raised or lowered on the support cable 20. In this case, the cable winch 22 comprises a winch drive, in a manner known in principle, which drive is actuated by means of a control unit (not shown).

In the event of an adjustment of the mast 16, and thus an adjustment of the support carrier 26, a position of the cable contact pressure means 40 can be adjusted by the base support 46, by means of a re-adjustment means 52, relative to the retaining carrier 26, and a changing position of the support cable 20 can be re-adjusted. For this purpose, the re-adjustment means 52 comprises an actuating cylinder 54 which can also be operated hydraulically.

FIG. 3 shows the state of the cable contact pressure means 40 in a contact pressure position, in which the two actuating members 50 are retracted such that the second contact pressure element 42*b* is displaced relative to the first contact pressure element 42*a*. In this state, the second contact pressure element 42*b* presses against the support cable 20. Furthermore, in the embodiment shown, the support cable 20 presses against the first contact pressure element 42*a*. As a result, the support cable 20 is clamped, as it were, between the two contact pressure elements 42, 42*b*, wherein, however, the use of a rotatable roller 44 also allows for a longitudinal movement of the cable 20. However, in this contact pressure position a movement transversely to the cable longitudinal direction of the support cable 20 is effectively prevented by the two contact pressure elements 42*a*, 42*b*.

If, for example when carrying out a method according to the invention, the work element 30 that is designed an impact weight 32 is then lowered onto the ground from an upper fall position, for example in a freefall mode, in order to exert an impact momentum on the ground for the purpose of soil compaction, a cable oscillation can develop on the support cable 20. Said cable oscillation of the support cable 20 can propagate beyond the mast head 18, as far as the winding drum 24. In this case, correct winding up of the support cable 20 on the winding drum 24 may be impaired. In order to prevent this, when the work element 30 strikes the ground, or a short time before, the cable contact pressure element 40 is actuated. The time of impact can be recorded or specified. In this case, the contact pressure elements 42*a*, 42*b* are displaced from the retracted position according to FIG. 2 into the contact pressure position according to FIG. 3. In the case of this contact pressure position according to FIG. 3, an oscillation of the support cable 20, which oscillation is determined, prevented, or significantly reduced or suppressed, mainly by a cable movement transversely to the normal longitudinal direction of the support cable 20.

Figure 4:
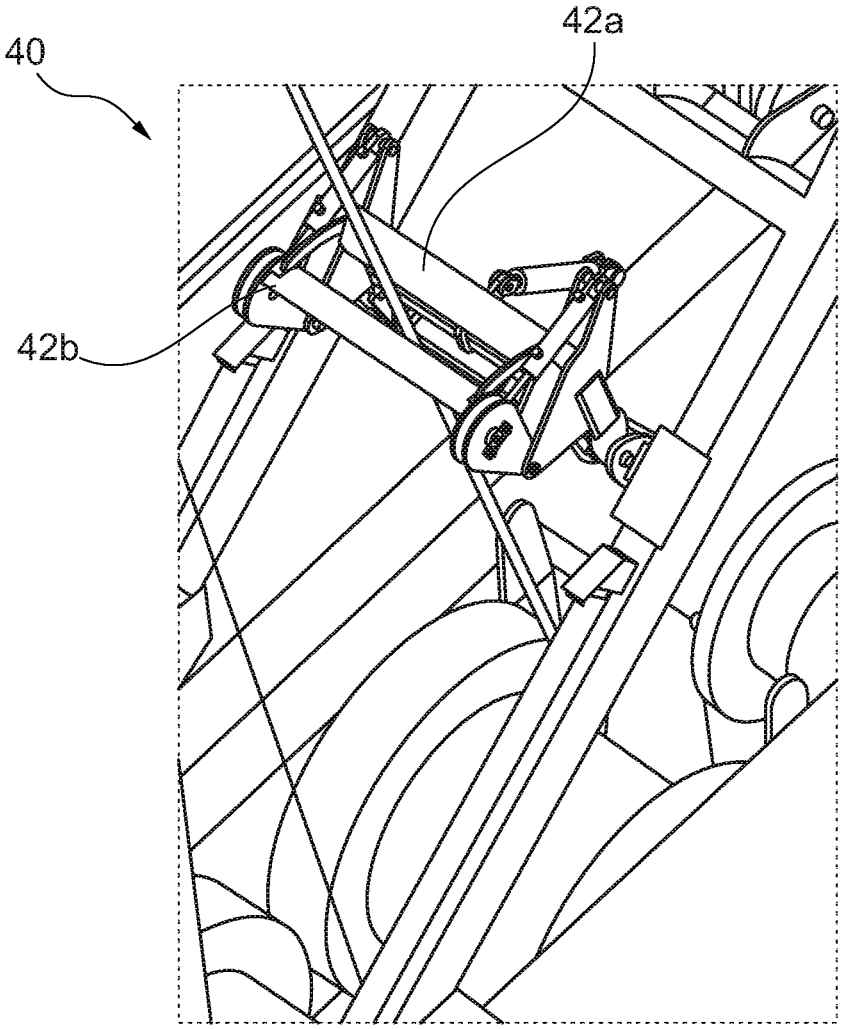
FIG. 4 is a perspective detail view of a second embodiment of a cable contact pressure means according to the invention.

FIG. 4 shows an amended embodiment of the cable contact pressure means 40 according to the invention. In this case, said cable contact pressure means is designed in substantially the same manner as the cable contact pressure means 40 according to FIGS. 2 and 3. However, the two contact pressure elements 42*a*, 42*b* are not designed as a roller, but rather as arcuate plates. In this case, FIG. 4 shows the state of the cable contact pressure means 40 having the contact pressure elements 42*a*, 42*b* in a retracted position according to FIG. 2.

Figure 5:
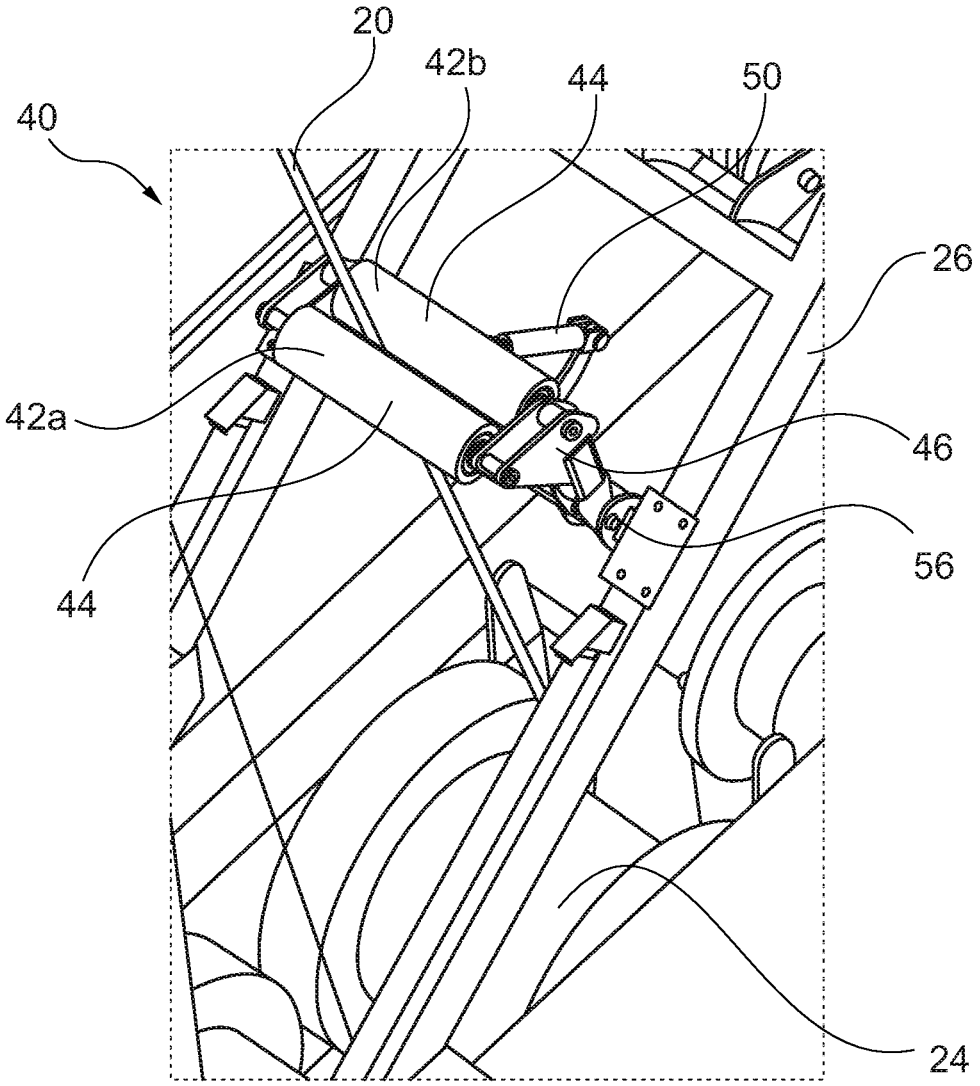
FIG. 5 is a perspective detail view of a third embodiment of a cable contact pressure means according to the invention.

A third embodiment of the cable contact pressure means 40 according to the invention is shown in FIG. 5. In this embodiment, the two contact pressure elements 42*a*, 42*b* are likewise designed as rotatable rollers 44, wherein said rollers, however, are at a fixed relative position with respect to one another, on the base support 46. In this case, FIG. 5 shows the retracted position, in which the support cable 20 is guided through the two contact pressure elements 42*a*, 42*b* in a largely unimpeded manner. In order to apply a contact pressure force, an actuating member 50 is provided, which member is preferably designed as a hydraulic cylinder. The actuating member 50 adjusts the base support 46, together with the two contact pressure elements 42*a*, 42*b*, relative to the retaining carrier 26, in particular about a swivel joint 56. As a result, at least one of the two contact pressure elements 42*a*, 42*b* is pressed against the support cable 20 which is deflected out of the normal, unimpeded throughput position thereof. Said application of a contact pressure force to the support cable 20, transversely to the longitudinal direction thereof, can likewise at least largely counteract propagation of an undesired cable oscillation of the support cable 20 on the winding drum 24.

Figure 6:
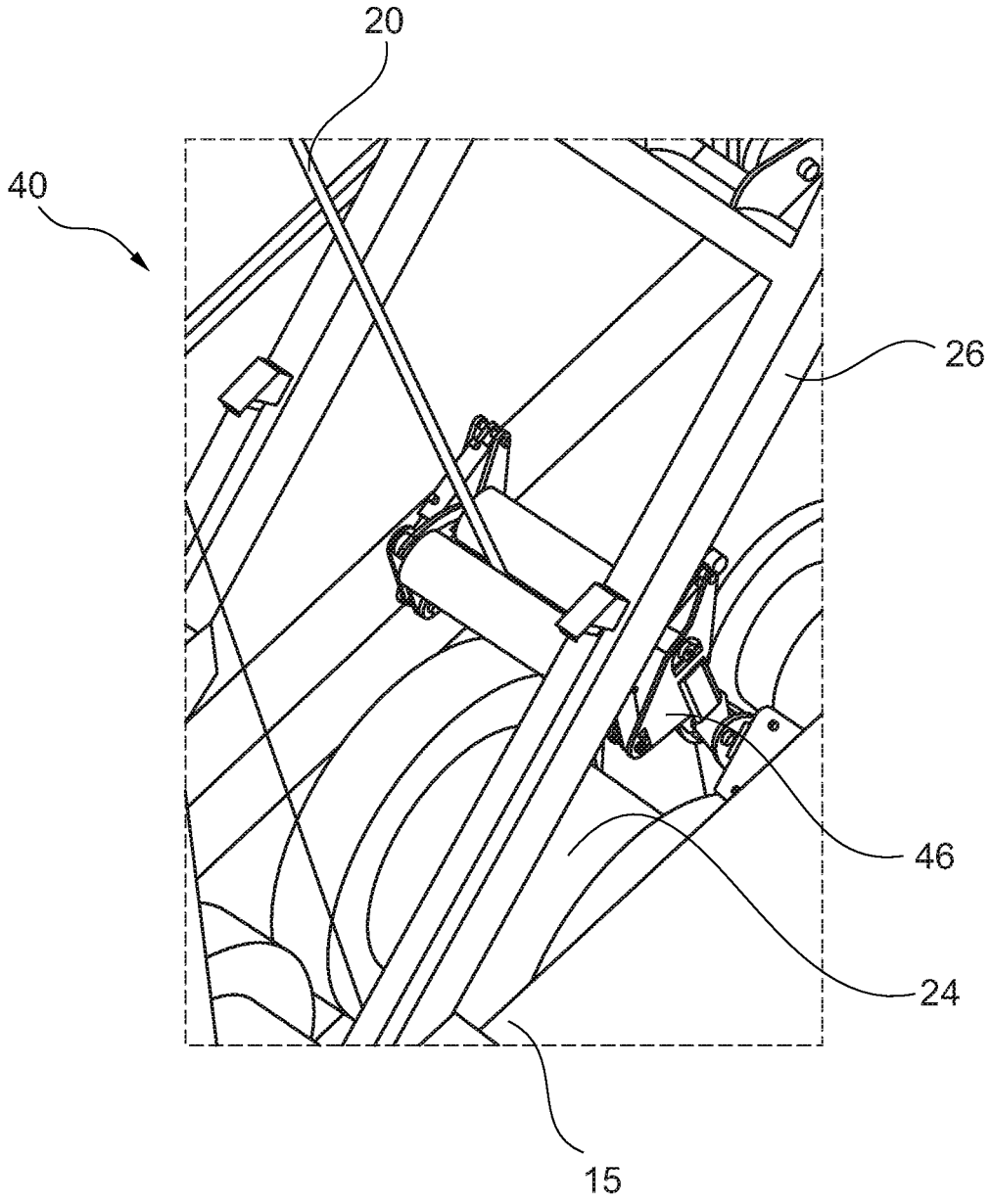
FIG. 6 is a perspective detail view of a fourth embodiment of a cable contact pressure means according to the invention.

A further embodiment of a cable contact pressure means 40 according to the invention is shown in FIG. 6, wherein said cable contact pressure means 40 is designed largely in a manner corresponding to the first embodiment according to FIGS. 2 and 3. In contrast to the first embodiment, however, said cable contact pressure means 40 is not attached to the retaining carrier 26 but rather directly to the superstructure 15 of the work machine 10, close to the winding drum 24. In this case, FIG. 6 shows the cable contact pressure means 40 in the contact pressure position.

Figure 7:
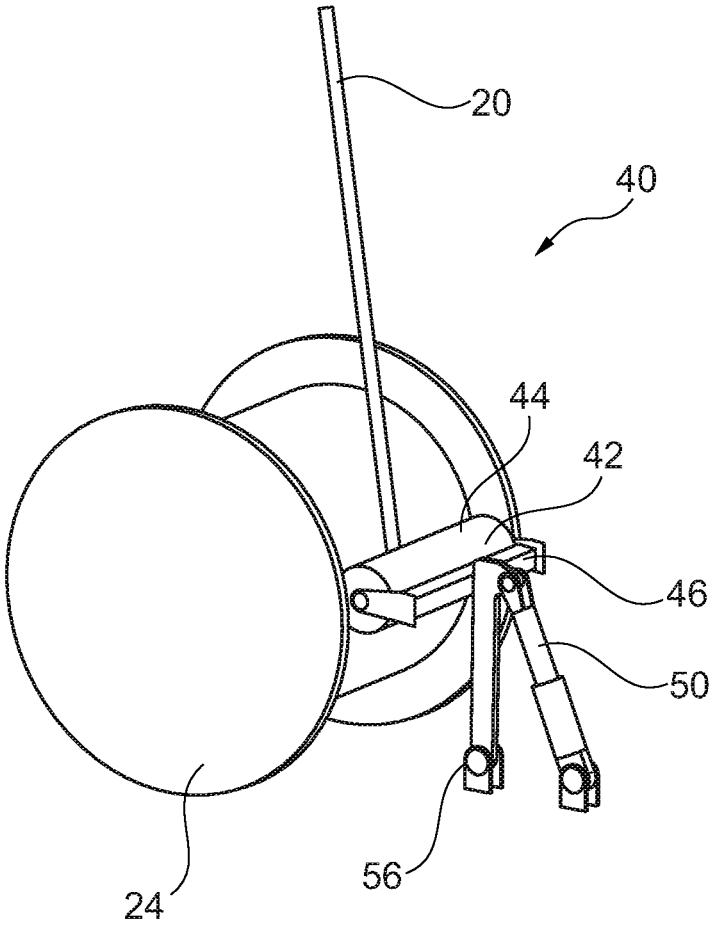
FIG. 7 is a perspective detail view of a fifth embodiment of a cable contact pressure means according to the invention.

A further embodiment according to the invention, of a cable contact pressure means 40, is shown in FIG. 7. In this case, the cable contact pressure means 40 comprises a single contact pressure element 42 which is rotatably mounted, as a roller 44, on a base support 46. The base support 46 itself is rotatably mounted about a swivel joint 56, wherein a swivel axis of the swivel joint 56 is oriented so as to be approximately in parallel with an axis of rotation of the winding drum 24. In order to press the contact pressure element 42 against the support cable 20, an actuating member 50 designed as a pressure cylinder is provided. In the embodiment shown, the actuating member 50 presses the support cable 20 directly against the winding drum 24, in the contact pressure position.

Figure 8:
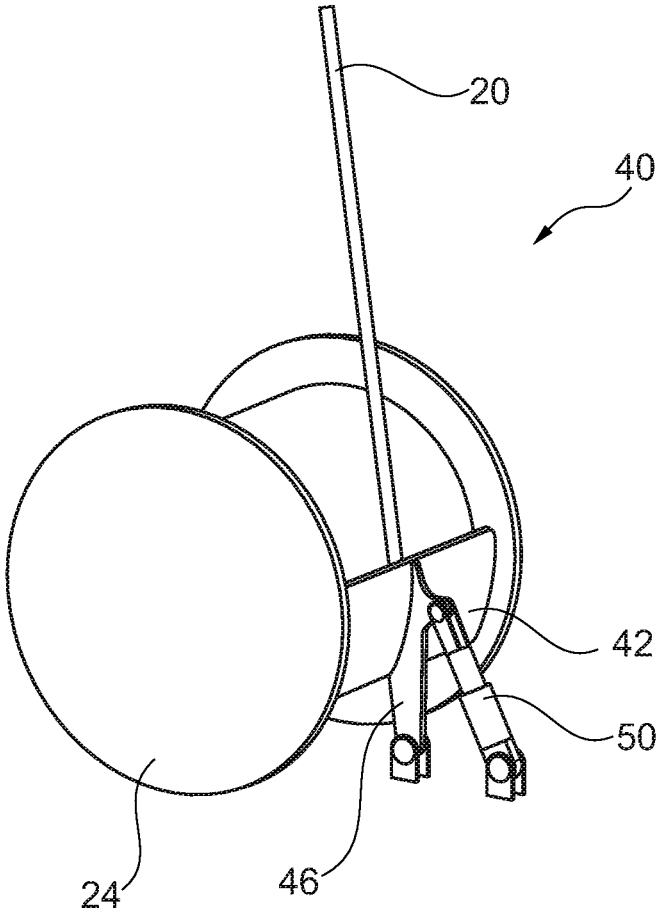
FIG. 8 is a perspective detail view of a sixth embodiment of a cable contact pressure means according to the invention.

A similar embodiment is shown in FIG. 8, wherein in this cable contact pressure means 40 according to the invention, a curved plate is provided as the contact pressure element 42. Said plate is likewise mounted on a base support 46 which is pressed directly against the winding drum 24 by means of an actuating member 50, such that the support cable is firmly clamped between the winding drum 24 and the contact pressure element 42.

The invention claimed is:

1. A work machine, comprising:

a mast having a mast head, a support cable which is guided along the mast, over the mast head, a cable winch comprising a rotatably mounted winding drum to which the support cable is attached for winding up and unwinding, a work element which is arranged on the support cable for vertical movement, and a control unit, by means of which the cable winch can be operated in an unwinding mode, for unwinding the support cable from the winding drum, in which the work element is lowered, on the support cable, as far as a base surface, wherein a cable contact pressure means with at least one contact pressure element is provided, which element can be adjusted into a contact pressure position by the control unit, by means of an actuating member, in order to counteract a cable oscillation of the support cable when the base surface is struck, in which contact pressure position the contact pressure element rests on the support cable at a contact pressure force.

2. The work machine according to claim 1, wherein the contact pressure element can be adjusted, by the control unit, from a retracted position into the contact pressure position either directly before, or while, the work element strikes the base surface.

3. The work machine according to claim 1, wherein the unwinding mode is a freefall mode.

4. The work machine according to claim 1, wherein the cable contact pressure means is arranged between the mast head and the winding drum, closer to the winding drum than to the mast head.

5. The work machine according to claim 1, wherein a single contact pressure element is pressed against the support cable in the contact pressure position.

6. The work machine according to claim 1, wherein the at least one contact pressure element is provided with a roller, on which the support cable comes to rest.

7. The work machine according to claim 1, wherein the contact pressure element presses the support cable against the winding drum in the contact pressure position.

8. The work machine according to claim 1, wherein two contact pressure elements are provided opposite one another, the support cable is guided through between the two contact pressure elements, and both contact pressure elements are pressed against the support cable in the contact pressure position.

9. The work machine according to claim 1, wherein a determination means is provided, which is designed for determining a position of the work element on the support cable and/or a tension state of the support cable, the determination means is connected to the control unit, and the cable contact pressure means can be actuated by the control unit depending on of the determined position and/or the state of the support cable.

10. The work machine according to claim 1, wherein the angular position of the mast relative to the vertical is adjustable, and the cable contact pressure means is adjustable depending on the position of the mast.

11. The work machine according to claim 1, wherein said machine is designed as a crawler crane, wherein an impact device for soil compaction is suspended on the support cable as the work element.

12. A method for operating a work machine, the method comprising:

providing the work machine with a support cable guided along a mast over a mast head, wherein the support cable is attached to a rotatably mounted winding drum of a cable winch for winding up and unwinding, a work element arranged on the support cable, which work element is moved vertically by the support cable, and a control unit for unwinding the support cable from the winding drum of the cable winch in an unwinding mode in which the work element is lowered as far as a base surface, and pressing at least one contact pressure element onto the support cable, in a contact pressure position, by the control unit, at a contact pressure, when the work element strikes the base surface, such that a cable oscillation of the support cable is counteracted.

13. The method according to claim 12, wherein the base surface is the ground including soil, the method comprising:

providing an impact weight as the work element, and repeatedly dropping the impact weight onto the ground, in a freefall mode, in order to compact the soil.

* * * * *